United States Patent [19]

Hall

[11] Patent Number: 4,630,771

[45] Date of Patent: Dec. 23, 1986

[54] ECONOMICAL FOUNTAINHEAD

[76] Inventor: Bill R. Hall, 2206 Annandale Rd., Huntsville, Ala. 35801

[21] Appl. No.: 799,786

[22] Filed: Nov. 20, 1985

[51] Int. Cl.[4] ..... B05B 17/08

[52] U.S. Cl. ..... 237/17; 239/553.3; 239/558; 239/DIG. 1

[58] Field of Search ..... 239/16–22, 239/248, 536, 553, 553.3, 554–556, 558, DIG. 1, DIG. 13

[56] References Cited

U.S. PATENT DOCUMENTS

| | | | |
|---|---|---|---|
| 158,903 | 1/1875 | Buttles | 239/248 |
| 549,359 | 11/1895 | Hawks | 239/556 X |
| 1,084,842 | 1/1914 | Bustin | 239/DIG. 1 X |
| 1,788,779 | 1/1931 | Regester | 239/553.3 X |
| 2,970,771 | 2/1961 | Przystawik | 239/536 X |

FOREIGN PATENT DOCUMENTS

| | | | |
|---|---|---|---|
| 246660 | 4/1966 | Austria | 239/18 |
| 648255 | 7/1937 | Fed. Rep. of Germany | 239/18 |

*Primary Examiner*—Joseph F. Peters, Jr.
*Assistant Examiner*—Mary Beth O. Jones

[57] ABSTRACT

The presently invented three tier fountainhead comprises several assembly orientations of modified standard Polyvinyl Chloride (PVC) plumbing parts to form three separate pressure chambers, each of which feed a different tier of water spray. Larger sized standard caps are joined to form the low pressure chamber; one or more intermediate sized caps are employed to form an intermediate pressure chamber; and a length of smaller standard sized PVC pipe is used to form the high pressure chamber which passes centrally through the low and intermediate pressure chambers and is modified with appropriate orifices to feed the low and intermediate pressure chambers. The high pressure chamber is capped at the upper end with a standard PVC cap with appropriate outlet orifices to form the upper tier. The low and intermediate pressure chambers include outlet orifices to form the lower and middle tiers respectively.

2 Claims, 4 Drawing Figures

ECONOMICAL FOUNTAINHEAD

BACKGROUND AND SUMMARY

By the laws of physics, in a multi-tier fountain, each tier must be fed by a different pressure of liquid to create the different tier heights. This requires the construction of a different pressure chamber to feed each tier. In the fountainhead industry today, this is generally accomplished with relatively expensive castings, molds, machinings and combinations thereof.

The fountainhead herein invented accomplishes the same goals using an unobvious application of standard, off-the-shelf, Polyvinyl Chloride (PVC) plumbing parts. This manufacturing method and material eliminates the need for special tooling or complicated processes for producing a multi-tier fountainhead. A further advantage of the presently invented fountainhead is the corrosion and ultraviolet resistance of the standard PVC materials of construction.

In essence, this invention uses primarily standard PVC pipe caps, intended for the capping of pipes, to form the necessary pressure chambers for a multi-tier fountainhead.

DRAWINGS

The features of the present invention are more fully set forth in the following detailed description of presently preferred embodiments of the invention, which description is presented with reference to the accompanying drawings, wherein.

Figure 4:
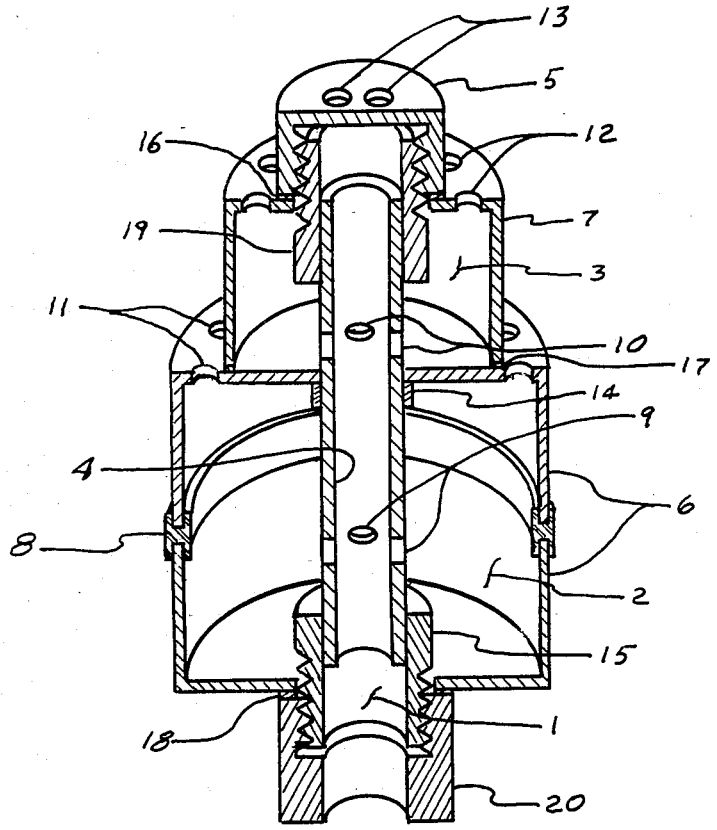

FIG. 4. is a cross-sectional isometric view of preferred embodiment four.

DESCRIPTION OF THE ILLUSTRATED EMBODIMENTS

Figure 1:
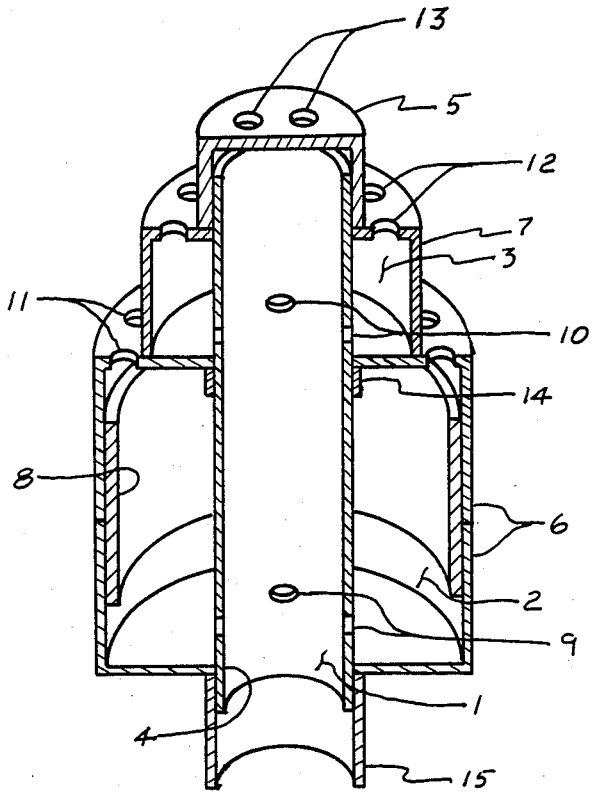
FIG. 1 is a cross-sectional isometric view of preferred embodiment one.

One embodiment of the invention is illustrated in FIG. 1. The general operation is as follows. The water enters the fountainhead vertically through coupling 15 and flows into high pressure chamber 1. From high pressure chamber 1, the water flows through orifices 13 to form the upper tier, and through orifices 10 into intermediate pressure chamber 3, from which it flows through orifices 12 to form the middle tier. From high pressure chamber 1 the water also flows through orifices 9 to enter low pressure chamber 2, from which it flows through orifices 11 to form the lower tier.

The detailed construction of the embodiment shown in FIG. 1 is as follows. The lower pressure chamber 2 is constructed of two larger PVC caps 6 connected to each other using cement and a length of matching sized larger PVC pipe 8. The larger caps 6 are both modified with a centrally located hole to allow the tight, axial passage of high pressure chamber 1. The upper larger cap 6 is modified with a set of orifices 11, circumferentially located around the outer edge of the upper surface. Orifices 11 are created in upper larger cap 6 at any angle required to produce the desired spread of the water spray in the lower tier.

Intermediate pressure chamber 3 is constructed from an intermediate sized PVC cap 7 and is centrally affixed with cement to the upper larger cap 6. Intermediate sized PVC cap 7 is modified with a centrally located hole to allow the tight, axial passage of high pressure chamber 1. Intermediate sized PVC cap 7 is also modified with orifices 12, circumferentially located around the outer edge of its upper surface, to allow an outlet means for water jets forming the middle tier. Orifices 12 are created at any angle required to produce the desired spread of the water in the middle tier.

High pressure chamber 1 passes axially through low pressure chamber 2 and intermediate pressure chamber 3 and is constructed of smaller sized standard PVC pipe 4, capped on its upper end by matching sized smaller PVC cap 5 which is cemented to smaller sized pipe 4 and intermediate sized cap 7, thereby creating a secure seal against intermediate sized cap 7. Smaller cap 5 is modified with one or more orifices 13, providing an outlet means from high pressure chamber 1 to form the upper tier. Orifices 13 are created in smaller cap 5 at any angle required to produce the desired water spray pattern for the middle tier. Smaller sized pipe 4 is modified with orifices 9, located in a manner to connect high pressure chamber 1 and low pressure chamber 2. Smaller sized pipe 4 is further modified with orifices 10, located in a manner to connect high pressure chamber 1 and intermediate pressure chamber 3.

Collar 14 is constructed from the end portion of a standard PVC pipe coupling sized to match smaller sized pipe 4. Collar 14 is cemented to upper larger cap 6 and to smaller sized pipe 4 to form a secure seal at the intersection of upper large sized cap 6 and smaller sized pipe 4.

Coupling 15 is a standard PVC pipe coupling sized to match smaller sized pipe 4. Coupling 15 is cemented to smaller sized pipe 4 and lower larger sized cap 6, thereby forming a secure seal at the intersection of lower larger sized cap 6 and smaller sized pipe 4. Coupling 15 also serves as a standard sized connection for connecting a supply water pressure source to the fountainhead.

The relative total area of orifices 9 and orifices 11 are coordinated to achieve the desired pressure in low pressure chamber 2 and hence the desired height and volume of water creating the lower tier.

The relative total area of orifices 10 and orifices 12 are coordinated to achieve the desired pressure in intermediate pressure chamber 3 and hence the desired height and volume of water creating the middle tier.

The total area of orifice(s) 13 is sized to achieve the volume of water desired for the upper tier. The height of the upper tier is determined by the selected supply water pressure.

Figure 2:
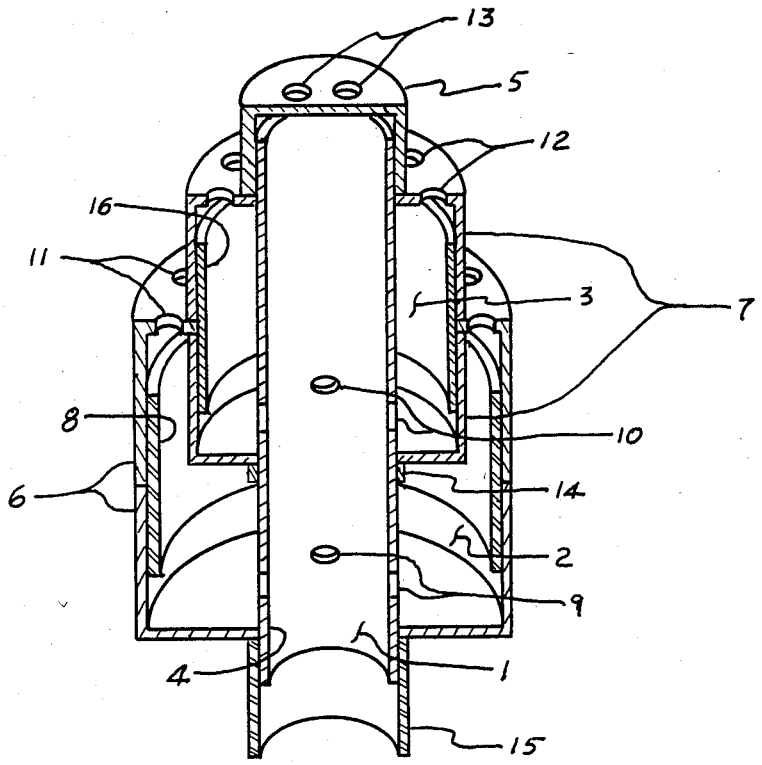
FIG. 2 is a cross-sectional isometric view of preferred embodiment two.

A second embodiment of the present inventions is illustrated in FIG. 2. The general operation of this embodiment is as follows. Water enters the fountainhead through coupling 15 and flows into high pressure chamber 1. From high pressure chamber 1, the water flows through orifices 13 to form the upper tier and through orifices 10 into intermediate pressure chamber 3, from which it flows through orifices 12 to form the middle tier. From high pressure chamber 1, the water also flows through orifices 9 into low pressure chamber 2, from which it flows through orifices 11 to form the lower tier.

The detailed construction of the invention embodiment two, illustrated in FIG. 2, is as follows. Low pressure chamber 2 is constructed from two larger sized standard PVC pipe caps 6 connected to each other using cement and a length of matching sized larger PVC pipe 8. The upper larger sized cap 6 is modified with a centrally located hole to allow the tight, axial passage of intermediate sized pipe 16 and modified with orifices 11 which are circumferentially located on the outer edge of the upper surface. Orifices 11 are created in the upper larger cap 6 at any angle required to produce the desired spread of water spray in the lower tier. The lower larger cap 6 is modified with a centrally located hole to allow the tight, axial passage of smaller sized pipe 4.

Intermediate pressure chamber 3 is constructed from two intermediate sized standard PVC pipe caps 7 connected to each other with a cemented length of matching intermediate sized PVC pipe 16. The upper intermediate sized cap 7 is modified with a centrally located hole to allow the tight, axial passage of smaller sized pipe 4 and with orifices 12 circumferentially located on the outer edge of the upper surface. Orifices 12 are created in the upper intermediate sized cap 7 at any angle required to produce the desired spread of water spray in the middle tier. The lower intermediate sized cap 7 is modified to allow the tight, axial passage of smaller sized pipe 4.

High pressure chamber 1 passes axially through low pressure chamber 2 and intermediate pressure chamber 3 and is constructed from a length of smaller sized standard PVC pipe 4, capped on its upper end with matching smaller sized standard PVC cap 5. Smaller sized cap 5 is cemented to smaller sized pipe 4 and to the upper intermediate sized cap 7, thereby creating a secure seal against the upper intermediate sized cap 7. Smaller sized cap 5 is modified with one or more orifices 13, producing an outlet means from the high pressure chamber 1 to form the upper tier. Orifices 13 are created in smaller sized cap 5 at any angle required to produce the desired spread of water spray for the upper tier. Smaller sized pipe 4 is modified with orifices 10, located in a manner to connect high pressure chamber 1 and intermediate pressure chamber 3. Smaller sized pipe 4 is also modified with orifices 9, located in a manner to connect high pressure chamber 1 to low pressure chamber 2.

Collar 14 is constructed from the end portion of a standard PVC pipe coupling sized to match smaller sized pipe 4. Collar 14 is cemented to lower intermediate sized cap 7 and to smaller sized pipe 4 to form a secure seal at the intersection of lower intermediate sized cap 7 and smaller sized pipe 4.

Coupling 15 is a standard PVC pipe coupling sized to match smaller sized pipe 4. Coupling 15 is cemented to smaller sized pipe 4 and lower larger sized cap 6, thereby forming a secure seal at the intersection of lower larger sized cap 6 and smaller sized pipe 4. Coupling 15 also serves as a standard sized connection for connecting a supply water pressure source to the fountainhead.

The relative total areas of orifices 9 and orifices 11 are coordinated to achieve the desired pressure in low pressure chamber 2 and volume of water creating the lower tier.

The relative total areas of orifices 10 and orifices 12 are coordinated to achieve the desired pressure in intermediate pressure chamber 3 and hence the desired height and volume of water creating the middle tier.

The total area of orifice(s) 13 is sized to achieve the volume of water desired for the upper tier. The height of the upper tier is determined by the selected supply water pressure.

Figure 3:
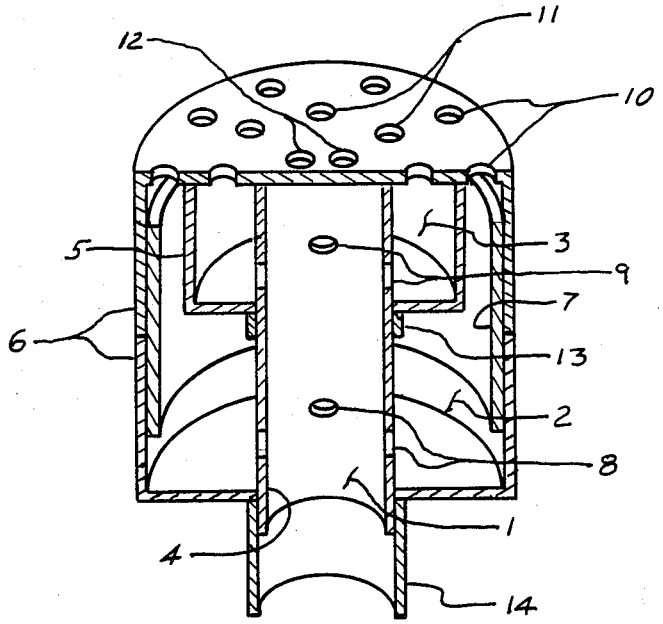
FIG. 3 is a cross-sectional isometric view of preferred embodiment three.

A third embodiment of the present invention is illustrated in FIG. 3. The general operation of this embodiment is as follows. Water enters the fountainhead through coupling 14 and flows into high pressure chamber 1. From high pressure chamber 1, the water flows through orifices 12 to form the upper tier and through orifices 9 into the intermediate pressure chamber 3, from which it flows though orifices 11 to form the middle tier. From high pressure chamber 1, the water also flows through orifices 8 into low pressure chamber 2, from which it flows through orifices 10 to form the lower tier.

The detailed construction of the embodiment shown in FIG. 3 is as follows. The lower pressure chamber 2 is constructed from two larger sized standard PVC pipe caps 6 which are connected to each other by a cemented length of matching larger sized standard PVC pipe 7. The lower larger sized cap 6 is modified with a centrally located hole to allow the tight, axial passage of smaller pipe 4. The upper larger cap 6 is modified with orifices 10, orifices 11, and orifices 12. Orifices 10 are circumferentially located on the outer edge of upper larger cap 6 such that they penetrate low pressure chamber 2. Orifices 11 are circumferentially located slightly inward from orifices 10 such that they penetrate intermediate pressure chamber 3. Orifices 12 are located centrally in upper larger cap 6 such that they penetrate high pressure chamber 1. Orifices 10, 11, and 12 are created at any angle required to produce the desired spread of water spray in the lower, middle, and upper tiers respectively.

Intermediate pressure chamber 3 is constructed from an intermediate sized standard PVC pipe cap 5 which is modified with a centrally located hole in the lower surface to allow the tight, axial passage of smaller sized pipe 4. Intermediate sized cap 5 is centrally cemented to the bottom surface of the upper larger sized cap 6.

Collar 13 is constructed from the end portion of a standard sized PVC coupling sized to match smaller sized pipe 4. Collar 13 is cemented to smaller sized pipe 4 and to intermediate sized cap 5 to form a secure seal between intermediate pressure chamber 3 and low pressure chamber 2.

High pressure chamber 1, passing axially though low pressure chamber 2 and intermediate pressure chamber 3, is constructed from a length of smaller sized standard PVC pipe 4. Smaller sized pipe 4 is modified with orifices 8, located such that they connect high pressure chamber 1 and low pressure chamber 2. Smaller pipe 4 is also modified with orifices 9, located such that they connect high pressure chamber 1 and intermediate pressure chamber 3.

The relative total areas of orifices 8 and orifices 10 are coordinated to achieve the desired pressure in low pressure chamber 2 and volume of water creating the lower tier.

The relative total areas of orifices 9 and orifices 11 are coordinated to achieve the desired pressure in intermediate pressure chamber 3 and water volume creating the middle tier.

The total area of orifices 12 is sized to achieve the desired volume of water for the upper tier.

Coupling 14 is a standard PVC pipe coupling sized to match smaller sized pipe 4. Coupling 14 is cemented to smaller sized pipe 4 and to lower larger cap 6, thereby creating a secure seal for high pressure chamber 1 and low pressure chamber 2. Coupling 14 also serves as a standard sized connection for connecting a water pressure supply source to the fountainhead.

A fourth embodiment of the invention is illustrated in FIG. 4. This embodiment has the particular advantage of being able to be disassembled for internal cleaning. The general operation of this embodiment is as follows. Water enters through the standard female PVC threaded adapter 20 and flows into high pressure chamber 1. From high pressure chamber 1 the water flows through orifices 13 to form the upper tier and through orifices 9 into low pressure chamber 2, from which it flows through orifices 11 to form the lower tier. The water also flows from high pressure chamber 1 through orifices 10 into intermediate pressure chamber 3, from which it flows through orifices 12 to form the middle tier.

The detailed construction of the embodiment illustrated in FIG. 4 is as follows. Low pressure chamber 2 is constructed from two larger sized standard PVC pipe caps 6 connected together at pliable, extruded gasket 8 by forces generated by the standard PVC female adapter 20 threads. The lower larger cap 6 is modified with a centrally located hole to allow the axial passage of the male threaded adapter 15. The upper larger cap 6 is modified with a centrally located hole to allow the axial passage of smaller pipe 4 and with orifices 11 circumferentially located on its outer edge so as to penetrate the lower pressure chamber 2.

Collar 14 is constructed from the end portion of a standard PVC pipe coupling sized to match smaller pipe 4. Collar 14 is cemented to smaller sized pipe 4 and upper larger cap 6 to form a seal between lower and intermediate pressure chambers 2 and 3.

Intermediate pressure chamber 3 is constructed from a standard intermediate sized PVC pipe cap 7 which is modified with a centrally located hole to allow the axial passage of standard male PVC threaded adapter 19. Intermediate sized pipe cap 7 is also modified with orifices 12 circumferentially located around its outer edge to form water outlet means to create the middle tier.

High pressure chamber 1 is constructed of a length of smaller sized standard PVC pipe 4 with a matching sized standard PVC male threaded pipe adapter 19 cemented to the upper end and a matching sized standard PVC male threaded pipe adapter 15 cemented to the lower end. The threads of male pipe adapter 19 are engaged with the threads in the standard PVC threaded pipe cap 5 to the extent that a sealing force is applied to pliable gasket 16 thereby creating a seal for intermediate pressure chamber 3. This same thread engagement applies a sealing force on pliable gasket 17, thereby forming a further seal for intermediate pressure chamber 3. The force created by the engagement of threads on male adapter 19 and threaded cap 5 is reacted by collar 14. Threaded pipe cap 5 is modified with orifices 13 to form an outlet means for water forming the upper tier. The threads of male threaded pipe adapter 15 are engaged with the threads of female threaded pipe adapter 20 to an extent that a sealing force is exerted on pliable gasket 18 thereby producing a seal for low pressure chamber 2. Female threaded pipe adapter 20 also serves as a standard sized connection for connecting the water pressure supply source to the fountainhead. Smaller sized pipe 4 is modified with orifices 9 located in a manner to connect high and lower pressure chambers 1 and 2. Smaller sized pipe 4 is also modified with orifices 10 located in a manner to connect high and intermediate pressure chambers 1 and 3.

Orifices 11, 12, and 13 are created at the required angle to produce the desired angle of spread on the water forming the lower, middle, and upper tiers respectively.

The relative total areas between orifices 9 and orifices 11 are coordinated to achieve the desired pressure in low pressure chamber 2 and volume of water emerging to form the lower tier.

The relative total areas between orifices 10 and orifices 12 are coordinated to achieve the desired pressure in intermediate pressure chamber 3 and the volume of water emerging to form the middle tier.

The total area of orifice(s) 13 is sized to achieve the desired volume of water emerging as the upper tier at the selected supply water source pressure.

Having described the invention, what is claimed as new in support of this patent is:

1. An ornamental fountainhead to produce three tiers of water spray which is constructed of slightly modified, standard Polyvinyl Chloride, PVC, plumbing parts to form different pressure chambers and flow paths to feed each tier, the construction consists of:

a low pressure chamber constructed of an upper and a lower large-sized standard PVC cap connected to each other by a cemented matching sized standard PVC pipe, the upper cap having an upper wall with a hole and having output orifices located circumferentially around the outer portion of the upper wall of said upper cap, the lower cap having a central hole;

an intermediate pressure chamber constructed of an upper and a lower intermediate-sized standard PVC pipe cap connected to each other by a cemented matching intermediate-sized standard PVC pipe, the intermediate-sized pipe tightly and axially penetrating the hole in the upper cap of the low pressure chamber, said upper and lower intermediate-sized caps abutting the upper and lower surfaces of the upper wall of the low pressure chamber, respectively, and being cemented thereto, forming a secure seal, the upper and lower caps of the intermediate pressure chamber having centrally located holes, the upper intermediate-sized cap having outlet orifices located circumferentially on the outer edge of the top surface;

a high pressure chamber being constructed from a small standard sized PVC pipe and capped at the upper end with a matching sized standard PVC cap, and having one or more outlet orifices on its upper surface, wherein the high pressure chamber passes tightly and axially through the hole in the lower cap of the low pressure chamber forming inlet pressure means for the fountainhead and passes tightly and axially through the holes in the upper and lower caps of the intermediate pressure chamber, the high pressure chamber pipe having an approximate number and sizes of orifices located in a manner to connect the low and intermediate pressure chambers to the high pressure chamber thereby creating a controlled source of water for the low and intermediate pressure chambers.

2. An ornamental fountainhead to produce three tiers of water spray which is constructed of slightly modified, standard Polyvinyl Chloride, PVC, plumbing parts to form different pressure chambers and flow paths to feed each tier, the construction consists of:

a low pressure chamber constructed of an upper and a lower large-sized standard PVC cap connected to each other by a cemented, matching sized standard PVC pipe and having a central hole in the lower cap and multiple outlet orifices located circumferentially around the outer edge of the upper surface of the upper cap such that they penetrate the inner volume of the low pressure chamber;

an intermediate pressure chamber constructed of an intermediate-sized standard PVC pipe cap having an upper rim centrally cemented to the under side of the upper wall of the low pressure chamber and having a central hole in a lower wall of the intermediate pressure chamber, said low pressure chamber having a set of outlet orifices located circumferentially around the mid-portion of the upper surface of the upper cap in such a manner as to penetrate the inner volume of the intermediate pressure chamber;

a high pressure chamber constructed of a small-sized standard sized PVC pipe, the upper end of the high pressure chamber being centrally cemented to the lower surface of the upper wall of the low pressure chamber, the lower end of the high pressure chamber pipe passing tightly and axially through the hole in the lower cap of the low pressure chamber and forming the inlet means for the fountainhead, and passing through the hole in the lower wall of the intermediate pressure chamber, the high pressure chamber pipe having outlet orifices located such that they connect the high pressure chamber with the low and intermediate pressure chambers, thereby providing a controlled inlet means for the low and intermediate pressure chambers, said low pressure chamber having a set of outlet orifices centrally located in the upper surface of the upper cap such that they penetrate the high pressure chamber.

* * * * *